US008033301B2

(12) United States Patent
Miwa

(10) Patent No.: US 8,033,301 B2
(45) Date of Patent: Oct. 11, 2011

(54) WATER SAVING TOOL

(75) Inventor: Kazuo Miwa, Shinjuku-ku (JP)

(73) Assignee: Technomirai Co., Ltd., Shinjuku-Ku, Tokyo (JP)

( * ) Notice: Subject to any disclaimer, the term of this patent is extended or adjusted under 35 U.S.C. 154(b) by 0 days.

(21) Appl. No.: 12/988,689

(22) PCT Filed: Oct. 31, 2008

(86) PCT No.: PCT/JP2008/069898
§ 371 (c)(1),
(2), (4) Date: Oct. 20, 2010

(87) PCT Pub. No.: WO2009/130812
PCT Pub. Date: Oct. 29, 2009

(65) Prior Publication Data

US 2011/0048560 A1 Mar. 3, 2011

(30) Foreign Application Priority Data

Apr. 23, 2008 (WO) ..... PCT/JP2008/057803
Jul. 25, 2008 (WO) ..... PCT/JP2008/063441

(51) Int. Cl.
*F15D 1/04* (2006.01)

(52) U.S. Cl. ..... 138/42; 138/37; 239/590; 239/499; 366/165.2; 366/337; 366/340

(58) Field of Classification Search ..... 138/37, 138/39, 42; 239/590, 590.3, 428.5, 499, 239/462; 366/165.1, 165.2, 337, 340, 341
See application file for complete search history.

(56) References Cited

U.S. PATENT DOCUMENTS 1,199,243 A * 9/1916 Bushey ..... 48/189.4
1,569,519 A * 1/1926 Middaugh ..... 48/189.4
(Continued)

FOREIGN PATENT DOCUMENTS

JP 3014423 U 8/1995
(Continued)

OTHER PUBLICATIONS

International Search Report (PCT/ISA/210) issued on Feb. 17, 2009, by Japanese Patent Office as the International Searching Authority for International Application No. PCT/JP2008/069898.

*Primary Examiner* — Patrick F Brinson
(74) *Attorney, Agent, or Firm* — Buchanan Ingersoll & Rooney PC

(57) ABSTRACT

Disclosed is a water saving device which provides the pressure and amount of water to be delivered that can satisfy the comfortable sense of water usage, regardless of whether the water may be supplied under the high pressure or low pressure or whether the water may be supplied in the larger or smaller amount. In accordance with the present invention, the water saving device comprises a hollow cylindrical body that is adapted to be attached to a water passage conduit or pipe. The hollow cylindrical body includes a first plate member disposed perpendicular to the direction of the water flowing through the water passage conduit or pipe. The first plate member has a plurality of first water passage holes formed thereon at regular intervals with regard to each other in the circumferential direction. A water guide member is further included. The water guide member is provided on the location where each of the first water passage holes is formed on the downstream side of the first plate member, and is capable of guiding the water flow in the circumferential direction while it causes the water to flow obliquely and downwardly toward the downstream side through each of the first water passage holes.

7 Claims, 9 Drawing Sheets

U.S. PATENT DOCUMENTS

| | | | | | |
|---|---|---|---|---|---|
| 1,689,446 | A | * | 10/1928 | Miller et al. | 48/189.4 |
| 2,561,457 | A | * | 7/1951 | Beales et al. | 366/268 |
| 3,158,177 | A | * | 11/1964 | Schulz et al. | 137/592 |
| 4,208,136 | A | * | 6/1980 | King | 366/338 |
| 4,600,544 | A | * | 7/1986 | Mix | 261/79.2 |
| 5,727,398 | A | * | 3/1998 | Phillippe | 62/503 |

FOREIGN PATENT DOCUMENTS

| | | | |
|---|---|---|---|
| JP | 3063817 | U | 11/1999 |
| JP | 2004-332288 | A | 11/2004 |
| JP | 2005-076273 | A | 3/2005 |
| JP | 2007-186970 | A | 7/2007 |

* cited by examiner (a)

(b)

(a)

(b)

WATER SAVING TOOL

BACKGROUND

1. Technical Field

The present invention relates to a water saving device that may be mounted on the automatic hand washing apparatus and the like in the washboard in such a manner that it can be used with such automatic hand washing apparatus.

2. Description of the Prior Art

Service or city water (which may be referred to simply as "water") is supplied from the municipal Waterworks Bureau into individuals' residence houses, commercial shops or stores and so on where the water may be delivered through the taps in the kitchens.

When water is supplied as described above, the water is delivered through the water supply mains (main pipe), and is then discharged through the tap. Therefore, the larger amount of water than it is required is usually discharged through the tap.

When the water is supplied under the higher pressure, the larger amount of water is also discharged, and if the water continues to be discharged under this condition, the amount of water being discharged will be increasing for one month or one year. Eventually, the very large amount of water might be discharged.

For the regions where water is supplied under the high pressure, such as the high-rise multi-floor hotels, the low-rise apartments and so on, much more water may be discharged since the water is supplied under the high pressure in those regions.

The above description applies for the individuals' housings, apartments (mansions), dormitories, sport facilities, barber shops or beauty hair solons and the like in which water is also supplied under the high pressure. In those establishments, the water tends to be used more frequently, and the more water is discharged as those establishments become larger in the scale.

For the regions where water is supplied under the low pressure, the water cannot be discharged well from the taps. In such situations, however, extra water may be discharged because the water is not discharged well from the taps.

For the regions where water is supplied under the low pressure, such as the high-rise floors in the high-rise multi-floor hotels, apartments (mansions) and the like, the same problem that occurs in the above situation will also occur when the water is supplied under the low pressure.

The same problem as described above will also occur when all floors in the high-rise multistage buildings have the same floor space and the people living there use one of the same water supply group pipes simultaneously during the same hours.

The same problems as described above may occur also for the individual housings, apartments (mansions), dormitories, sport facilities and the like.

For the conventional taps, the pressure and amount of water being supplied are such that the water may be discharged directly through the water discharging port that is located above the mains water delivery port on the water supply side, and the amount of water more than it is required may be discharged and used. Thus, this increases the cost accordingly.

In order to solve the problems described above, various devices that are mounted on the taps and are designed to save the water have been proposed. For example, there is a device that is described in the documents No. 2007-186970 and No. 3014423 in which the device may be mounted on the water passage pipe, and is designed to save the water by forcing a flow motion to occur in the water while it is flowing through the water passage pipe.

SUMMARY OF THE INVENTION

It is an object of the present invention to propose a water saving device that can provide the pressure and amount of water under the comfortable conditions, whether the water may be supplied under the high pressure or under the low pressure from the water supplying source, or whether the larger or smaller amount of water may be supplied from the water supplying source. The water saving device according to the present invention is also designed to minimize the water usage per unit time (such as per unit hour) under the above conditions.

In order to achieve the above object, the water saving device proposed by the present invention has the constructional features that will be described below.

The water saving device of the invention as defined in Claim is characterized by the fact that it comprises a hollow cylindrical body which is adapted to be attached to a water passage conduit or pipe, wherein the hollow cylindrical body includes a first plate member disposed perpendicularly to the direction of the water flow passing through the water passage conduit or pipe from the side of the hollow cylindrical body to be attached to the water passage conduit or pipe toward the downstream side, the first plate member having a plurality of first water passage holes formed at regular intervals with regard to each other along the circumferential direction, and a water guide member provided for guiding the water flow along the same circumferential direction and located in the position in which each of the first water passage holes is formed on the downstream side wall of the first plate member, while the flow of the water flowing on the downstream side through each of the first water passage holes is directed toward the oblique and downward direction.

The advantage of the present invention over the prior art lies in that the water saving device proposed by the present invention can provide the pressure and amount of water under the comfortable conditions, whether the water may be supplied under the high pressure or under the low pressure from the water supplying source, or whether the larger or smaller amount of water may be supplied from the water supplying source, and is also designed to minimize the water usage per unit time (hours) under the above conditions. Particularly, the water saving device of the present invention can preferably be used in conjunction with the automatic hand washing apparatus of the type in which it is automatically operated to deliver the water through the tap when a human hand is placed just below the tap.

BEST MODE OF EMBODYING THE INVENTION

The water saving device according to the present invention is designed to save the water by forcing the water flowing through the water passage conduit or pipe to produce a swirling flow that occurs from the upstream side toward the downstream side so that the water can flow in the circumferential direction while the water can flow obliquely and in the downward direction.

Several examples of the preferred embodiment according to the present invention will be described below by referring to the accompanying documents.

Embodiment 1

FIG. 1 is a cross sectional view illustrating the first example of the preferred embodiment of the water saving device according to the present invention, although some parts are omitted.

As shown in FIG. 1, the water saving device 1 according to the first embodiment of the present invention comprises a hollow cylindrical body 2 having its top side to be attached to the water passage conduit (not shown).

Within the hollow cylindrical body 2, there are a first plate member 3 and a second plate member 4 which are disposed in parallel with each other so that they are directed from the sides thereof (the upper sides in FIG. 1) to be attached to the water passage conduit toward the downstream sides thereof (the lower sides in FIG. 1). Each of the first plate member 3 and second plate member 4 is arranged perpendicularly to the direction of the water flow passing through the water passage conduit (in the direction of the arrow 100).

The first plate member 3 includes a plurality of first water passage holes 8*a*, 8*b*, 8*c*, 8*d* (which may be referred to collectively as the reference numeral 8) which are arranged at regular intervals with regard to each other in the circumferential direction. The first plate member 3 also includes a water guide member 15 which is provided in the position on the downstream side wall in the first plate member 4 on which each of the first water passage holes 8 is formed. The guide member 15 is provided for causing the water flow toward the downstream side through each of the first water passage holes 8 to be directed obliquely and in the downward direction while the water flow is being guided in the same circumferential direction.

In the embodiment shown, four first water passage holes 8*a*, 8*b*, 8*c*, 8*d* are provided at an interval of 90 degrees with regard to each other in the circumferential direction of the first plate member 3. The water flow that occurs in the downstream direction through each of the first water passage holes 8*a*, 8*b*, 8*c*, 8*d* may be directed by the guide member 15 in the oblique and downward direction as shown by the arrow 102 (FIG. 1), while the water flow is being guided in the circumferential direction as shown by the arrow 9 (FIG. 2 (*a*)).

As an alternative embodiment which is not shown, two, three, or six first water passage holes 8 may be provided at an interval of 180 degrees, 120 degrees, or 60 degrees with regard to each other in the circumferential direction, respectively.

In the embodiment shown, the water guide member 15 includes a guide lateral wall 13 and a guide bottom plate 14.

On the downstream side wall in the first plate member 3 as shown in FIGS. 3 (*a*) and (*b*), the guide lateral wall 13 is provided so that it extends toward the downstream side from the outer side edge of the first water passage hole 8*a* located radially outside and from the inner side edge of the first water passage hole 8*a* located radially inside and opposite the outer side. For example, on the downstream side wall in the first plate member 3, the guide lateral wall 13 may be provided so that it can extend in parallel with the water flow passing through the water passage conduit in the direction of the arrow 100 and toward the downstream side from the outer side of the first water passage hole 8*a* located radially outside and the inner side edge of the first water passage hole 8*a* located radially inside and opposite the outer side.

In the embodiment shown in FIGS. 1 and 2, on the downstream side wall in the first plate member 3, the inner peripheral wall of the hollow cylindrical body 2 serves as the guide lateral wall 13 extending toward the downstream side from the outer side edge of the first water passage hole 8 located radially outside.

In the embodiment shown in FIGS. 1 and 2, therefore, on the downstream side wall in the first plate member 3, only the guide lateral wall 13 is shown, which extends toward the downstream side from the inner side of the first water passage hole 8 located radially inner side.

As shown in FIGS. 3 (*a*) and (*b*), the guide bottom plate 14 is provided so that the outer side edge located radially outside and the inner side edge located radially inside are attached to the guide lateral wall 13. Then, the guide bottom plate 14 is inclined downwardly from the side edge located on the upstream side of the water flowing in the circumferential direction and being guided by the water guide member 15 of the first water passage hole 8 toward the direction in which the side edge of the water flow in the circumferential direction is located opposite the upstream side.

In the embodiment shown, the guide bottom plate 14 of the guide member 15 that is located on the location of the first water passage hole 8*a* is inclined downwardly to the left by an angle of 45 degrees. In this manner, the guide bottom plate 14 is inclined downwardly from the side of the water flow located on the upstream side of the water flow occurring in the circumferential direction and being guided by the guide member 15 of the first water passage hole 8*a* toward the direction in which the side of the water flow occurring in the circumferential direction is located opposite the upstream side of the water flow.

This angle at which the water guide member 15 of the guide bottom plate is inclined downwardly may be determined as appropriate by considering the factors such as the pressure and amount of water flow, the dimensions of the water saving device, and the like.

In the embodiment shown in FIG. 1 and FIG. 2 (*a*), the side of the guide bottom plate 14 located radially outside is attached to the inner peripheral wall of the hollow cylindrical body 2 serving as the guide lateral wall 13, and the side of the guide bottom plate 14 located radially outside is attached to the radial outside surface of the guide lateral wall 13.

In this manner, the water that has flowed through first water passage hole 8*a* as shown by the arrow 101 (FIG. 1) will be guided by the guide bottom plate 14, flowing obliquely and downwardly as shown by the arrow 102. Then, the water will be guided to the inner peripheral wall of the hollow cylindrical body 2 and to the radial outside surface of the guide lateral wall 13. Then, the water will be guided in the circumferential direction as shown by the arrow 9 (FIG. 2 (*a*)).

As the guide member 15 provided in each of the remaining first water passage holes 8*b*, 8*c*, 8*d* is functionally and structurally equivalent to the water guide member 15 provided in the first water passage hole 8*a*, the further explanation of those first water passage holes 8*b*, 8*c*, 8*d* is omitted.

As described above, the water that has flowed through each first water passage hole 8 as shown by the arrow 101 (FIG. 1) may flow obliquely downwardly as shown by the arrow 102, and may then be guided to the inner peripheral wall of the hollow cylindrical body 2 and to the radial outside surface of the guide lateral wall 13. Then, the water may be guided along the circumferential direction as shown by the arrow 9 (FIG. 2 (*a*)). In the region 6 located on the downstream side of the first plate member 3 and delimited by the first and second plate member 3 and 4, the water may be caused to flow toward the downstream side along the circumferential direction as shown by the arrows 103*a* and 103*b* (FIG. 1).

Additionally, as the water saving device 1 is usually used with its top side being attached to the water passage conduit (not shown), the first water passage holes 8 have the total water passage cross-sectional area that is smaller than that of the water passage conduit (not shown). Thus, the water that passes through each of the first water passage holes 8 in the direction of the arrow 102 can flow at a faster rate than when the water flows through the water passage conduit (not shown) in the direction of the arrow 100.

In the water saving device of the present invention, the total water passage cross-sectional area of the first water passage holes 8 may be smaller than that of the water passage conduit (not shown) as described above, and therefore the water can flow through the first water passage holes 8 at a faster rate than the water flows through the water passage conduit (not shown). Then, the water may be guided by the water guide member 15 along the circumferential direction (arrow 9) while it is being directed in the oblique and downward direction (arrow 102).

Then, the water can flow more energetically than when it flows through the first water passage holes 8 in the direction of the arrow 102, flowing toward the downstream side of the first plate member 3 at a faster rate than when the water is entering through the first water passage holes 8.

One feature of the water saving device of the present invention is that the water being stored in the first water storage room 6 through the first water passage holes 8 on the first plate member 3 can be guided by the water guide member 15 so as to flow in the circumferential direction (allow 9) while it is flowing in the oblique and downward direction (arrow 102).

In this manner, the water flow that has been guided by the water guide member 15 so that the water can flow in the same circumferential direction (arrow 9) while it is being directed toward the oblique and downward direction will occur toward the downstream side of the first plate member 3 while it can retain its energetic flow.

As described above, the water guide member 15 comprises the hollow cylindrical body including the guide lateral wall 13 and the guide bottom plate 14, wherein there is a water guide path having an inlet 20*a* on the first water passage hole 8*a* and an outlet 20*b* on the tip extending toward the downstream side of the hollow cylindrical body. The water guide path has its water flow cross-sectional area that decreases gradually from the side of the inlet 20*a* toward the side of the outlet 20*b*.

The water guide member 15 that is constructed as described above is now described in more detail by referring to FIG. 3.

As shown in FIG. 3, the water guide member 15 includes the guide bottom plate 14 with an upper guide plate 14*a* facing opposite the guide bottom plate 14. The water guide member 15 is formed in such a manner that it can be delimited by the guide bottom plate 14, the guide lateral wall 13 on the radially outer side (or the inner peripheral wall of the hollow cylindrical body 2 serving as the guide lateral wall 13), the upper guide plate 14*a* and the guide lateral wall 13 on the radially inner side. The upper guide plate 14*a* is not in parallel with the guide bottom plate 14, but its left-side end is inclined so that it comes closer to the guide bottom plate 14 as shown in FIG. 3 (*a*). Thus, the water guide path has its water flow cross-sectional area that decreases gradually from the inlet side 20*a* toward the outlet side 20*b*.

FIG. 3 (*b*) is used to explain that the inlet side 20*a* has the water flow cross-sectional area that is larger than that for the outlet side 20*b*.

As the water guide member 15 described above is constructed as shown in FIG. 3, the water that has flowed into the first water passage hole 8*a* (through the inlet side 20*a*) will be able to flow out of the outlet side 20*b* at the flow rate faster than the inlet side flow rate. In this manner, the function of the water guide member 15 can be performed much more effectively so that it can cause the water to flow along the same circumferential direction (in the direction of the arrow 9) while the water flow can be directed in the oblique and downward direction (in the direction of the arrow 102) toward the downstream side.

It should be noted that instead of using the upper guide plate 14*a* facing opposite the guide bottom plate 14 as described previously, the water guide path may be provided by delimiting it by the guide bottom plate 14, the guide lateral wall 13 on the radially outer side (or the inner peripheral wall of the hollow cylindrical body 2 serving the guide lateral wall 13 on the radially outer side), the face of the first plate member 3 being directed toward the downstream side, and the guide lateral wall 13 on the radially inner side. In this case, the water flow cross-sectional area of the water guide path can be decreased gradually from the inlet side 20*a* toward the outlet side 20*b*, by adjusting the angle at which the guide bottom plate 14 or the guide lateral wall 13 on the radially inner side is to be mounted when it is mounted.

The first water passage hole 8 and water guide member 15 may also be provided so that they can have the construction and type employed in the embodiment 2 to be described later. Specifically, the water guide member 15 is formed by bending the triangular-shaped portion 62 for forming each on the first water passage hole such that it can be inclined downwardly toward the downstream side at the position in which each of the first water passage hole is formed on the first plate member 3, and the water guide member 15 is provided so that it can guide the water flow along the same circumferential direction (the direction of the arrow 9) between the face located on the inner peripheral wall of the hollow cylindrical body 2 and the surface of the above bent triangular-shaped portion 62 while the water flow is being directed toward the oblique and downward direction (the direction of the arrow 102).

The water guide may be achieved by providing a cut line on the location shown by numerals 59, 60 as described in FIG. 7 (*a*) and FIG. 9 that is situated on the position in which each of the first water passage holes 8 is formed on the first plate member 3, and bending the tip 63 of the triangular-shaped portion 62 so that the tip 63 can be inclined downwardly toward the downstream side with the position of the broken line shown in the numeral 61 being the bending line.

In this manner, the water flow may be guided along the same circumferential direction while it is being directed toward the oblique and downward direction (the direction of the arrow 102) between the inner wall side face of the hollow cylindrical body 2 and the surface of the triangular-shaped portion 62 thus bent as described above.

In this case, the size of the triangular-shaped portion 62 may be determined as appropriate by considering the factors such as the magnitude of the water pressure and amount, and the size of the water saving device. The angle at which the triangular-shaped portion 62 is to be bent obliquely and downwardly with the broken line 61 being the bending line may also be determined by considering the factors such as the magnitude of the water pressure and amount, and the size of the water saving device.

According to the water saving device of the present invention, the first plate member 3, the first water passage holes 8, and the water guide member 15 have the type and construction that allow the water to flow more energetically toward the downstream side like a swirling flow. Particularly, this eliminates the need of using the second plate member 4.

It should be noted, however, that the second plate member 4 may be provided in parallel with the first plate member 3 on the downstream side of the first plate member 3, and a plurality of second water passage holes may be provided on the second plate member 4 so that the water can flow through each of the second passage holes toward the downside direction (that is, the downstream side).

Because of the presence of the second plate member 4 and second water passage holes thereon, the water saving device according to this embodiment can provide the pressure and amount of water that can satisfy the requirements for the more comfortable sense of usage, and can reduce the usage of the water per unit time much further.

In the embodiment shown in FIG. 1 and FIG. 2, the second plate member 4 has the inner-side second water passage holes 17*a*, 17*b*, 17*c*, 17*d* (which may be referred to collectively as the numeral 17 in the specification and drawings) formed at regular intervals with regard to each other along the circumferential direction and extending in the circumferential direction and radially outside as shown in FIG. 2 (*b*). Furthermore and similarly, the second plate member 4 has the outer-side second water passage holes 18*a*, 18*b*, 18*c*, 18*d* (which may be referred to collectively as the numeral 18 in the specification and drawings) formed at regular intervals with regard to each other along the circumferential direction and extending radially outside in the circumferential direction, the outer-side second water passage holes being located radially outer side than the inner-side second water passage holes.

In the embodiment shown, the plurality of second water passage holes includes the inner-side second water passage holes 17 and outer-side second water passage holes 18, and is formed at regular intervals with regard to each other along the circumferential direction and extends in the circumferential direction on the radial outer portion of the second plate member 4.

It should be noted, however, that the plurality of second water passage holes that extends along the circumferential direction on the radial outer side portion of the second plate member 4 may be formed by either the inner-side second water passage holes 17 only, or the outer-side second water passage holes 18 only.

The total water passage cross-sectional area (in the embodiment shown, this is substantially equal to the total water passage cross-sectional area for the inner-side second water passage holes 17 combined with the total water passage cross-sectional area for the outer-side second water passage holes 18) is smaller than the total water passage holes for the first water passage holes 8.

As the total water passage cross-sectional area for the second water passage holes is smaller than that for the first water passage holes 8, the water that has passed through the second water passage holes can flow at a faster rate when the water is delivered by the water saving device toward the downstream side as shown by the arrow 106 (FIG. 1).

As the plurality of second water passage holes is formed on the radially outer portion of the second plate member 4, extending along the circumferential direction, the user can have the comfortable sense of usage because the amount of the water per unit time being delivered in the direction of the arrow 106 can be kept to the controllable minimum.

FIG. 4 and FIG. 5 illustrate other forms and types of the water saving device 1 that is currently described according to this embodiment. As the water saving device 1 shown in FIGS. 4 and 5 according to those other forms and types includes parts common to those of the water saving device 1 shown in FIGS. 1 and 2 and which are given similar reference numerals, the water saving device 1 shown in FIGS. 4 and 5 will not be described any further.

The water saving device 1 of the present invention shown in FIGS. 4 and 5 has the compact size as compared with the water saving device described using FIGS. 1 and 2.

For the water guide member 15 in the saving device shown in FIGS. 4 and 5, the inner peripheral wall of the hollow cylindrical body 2 is not used as the guide lateral wall extending toward the downstream side from the location of the radially outer side of the first water passage hole 8*a* on the wall of the first plate member 3 on the downstream side thereof. Specifically, the water saving device in FIGS. 4 and 5 differs from the water saving device of the present invention described using FIGS. 1 and 2 in that the guide lateral wall 13 extending toward the downstream side from the location of the radially outer side of the first water passage hole 8*a* on the wall of the first plate member 3 on the downstream side thereof is also shown.

Furthermore, the water waving device in FIGS. 4 and 5 differs from the water saving device described using FIGS. 1 and 2 in that the upper side to be attached to the water passage conduit is threaded. In the embodiment shown in FIG. 4, the inner periphery on the upper side of the hollow cylindrical body 2 has a threaded portion.

In other respects, the water saving device in FIGS. 4 and 5 is similar to the water saving device in FIGS. 1 and 2, and is not described any further.

Embodiment 2

Another embodiment of the present invention is now described by using FIG. 6 through FIG. 9.

The embodiment 2 which is now described by using FIG. 6 through FIG. 9 includes some components that are common to those in the embodiment 1 described by using FIG. 1 through FIG. 5, and those components are given common reference numerals. Therefore, the description of those common components will be omitted to avoid the duplicate description.

In the water saving device 1 according to the embodiment 1, a plurality of second water passage holes 17, 18 are formed on a second plate member 4, and are provided on the radially outer side of the second plate member 4 so that they can extend along the circumferential direction. The second water passage holes 17, 18 have the total water passage cross-sectional area that is smaller than the total water passage cross-sectional area of the first water passage holes 8.

As opposed to the water saving device in the embodiment 1, the water saving device of the present invention can perform its function as the water saving device, regardless of the locations of the plurality of second water passage holes formed on the second plate member 4 and regardless of the sizes of the water passage cross-sectional area, provided that the plurality of second water passage holes are capable of discharging the water toward the downward direction (in the direction of the arrow 106) like the water saving device 51 in the embodiment 2.

A variation of the water saving device 1 in the embodiment 2, which is shown by 51, also comprises the hollow cylindrical body 2 as shown in FIG. 6, and the upper side of the hollow cylindrical body 2 in FIG. 6 may be attached to the water passage conduit (not shown) when it is actually used.

In the embodiment shown, the second plate member 4, which has the flat round shape, may be inserted into the hollow cylindrical body 2 from its upper side, and then may be mounted on the stepped portion 58 around the inner peripheral wall of the hollow cylindrical body 2. After this is done, the cylindrical spacer 56 and the first plate member 3 having the flat, round shape may be inserted into the hollow cylindrical body 2 from its upper side in the order listed above.

The first plate member 3 and the second plate member 4 have the same diameter. The cylindrical spacer 56 is used so that the first and second plate members 3 and 4 can have the same diameter on the upper and lower directions.

The embodiment 2 is the same as the embodiment 1 in that the first plate member 3 having the flat, round shape includes the plurality of first water passage holes 8*a*, 8*b*, 8*c*, 8*d* (which may be referred to collectively to the numeral 8) formed at regular intervals with regard to each other along the circumferential direction, and the water guide member 15. In this manner, the flow of water flowing toward the downstream side through the first water passage holes 8 can be guided by the water guide member 15 so that it can be directed toward the oblique and downstream side as shown by the arrow 102 (FIG. 6) and then along the same circumferential direction as shown by the arrow 9 (FIG. 7 (*a*)).

The water guide member 15 in the water saving device 51 according to the present invention 2 includes the triangular-shaped portion 62 provided for forming each of the first water passage hole 8 and which is bent to slant downwardly at the position in which each of the first water passage hole 8 is formed on the first plate member 3, and the water guide member 15 is capable of guiding the water flow along the same circumferential direction toward the oblique and downward direction (the direction of the arrow 102) between the face on the inner peripheral wall of the hollow cylindrical body 2 and the surface of the thus bent triangular-shaped portion 62.

For the water saving device 51 according to the embodiment 2, the water guide member 15 may be formed by bending the triangular-shaped portion 62 delimited by the solid line 59, the solid line 60 and the broken line 61 on the first plate member 3 toward the downward direction in FIG. 8. In the first plate member 3, a cut line may be provided in the solid line portion 59 and solid line portion 60. Then, the tip 63 of the triangular-shaped portion 62 intersected by the solid line 59 and solid line 60 may be bent in the downward direction in FIG. 6 and FIG. 8, with the broken line 61 being the bent line portion. For example, the triangular-shaped portion 62 may be bent from the broken line 61 corresponding to the bent line portion so that it can be inclined downwardly by 45 degrees relative to the horizontal first plate member 3.

When the first water passage holes 8 are formed in this manner, the water flow going toward the first plate member 3 as shown by the arrows 100 and 101 may be directed obliquely and downwardly as shown by the arrow 102 (FIG. 6) while it is being directed along the circumferential direction as shown by the arrow 9 along the inner periphery of the cylindrical spacer 56.

The water that has been delivered under the applied pressure from the water passage conduit (not shown) as shown by the arrow 100 (FIG. 6) will pass through each of the first water passage holes 8, and will then flow toward the downstream side along the triangular-shaped portion 62 slanting toward the oblique and downward direction while the water is being directed toward the oblique and downward direction as shown by the arrow 102. At the same time, the water will be guided between the inner peripheral wall of the spacer 56 and the surface of the slanting triangular-shaped portion 62, and will then guided along the peripheral direction as shown by the arrow 9. On the downstream side of the first plate member 3, then, the water flow will be produced, allowing the water to flow toward the downward along the peripheral direction as shown by the arrows 103*a*, 103*b*.

In addition, as the water saving device 51 is provided so that it may be used by connecting its upper side to the water passage conduit (not shown), the total water passage cross-sectional area of the first water passage holes 8 is smaller than that of the water passage conduit (not shown). Thus, the water passing through each of the first water passage holes 8 and flowing in the direction of the arrow 102 may flow at a faster rate than the water flowing through the water passage conduit (not shown) as shown by the arrow 100.

In the above description, the size of the triangular-shaped portion 62 delimited by the solid line 59, solid line 60 and broken line 61 may be determined as appropriate by considering the factors such as the pressure under which the water is to be supplied, the amount of the water that is to be supplied, and the dimension of the water saving device. In addition, the angle at which the triangular-shaped portion 62 is to be bent toward the oblique and downward direction with the broken line 61 being as the bending line portion may also be determined as appropriate by considering the factors such as the pressure under which the water is to be supplied, the amount of the water that is to be supplied, and the dimension of the water saving device.

In the water saving device 51, as the total water passage cross-sectional area for the first water passage holes 8 is smaller than that for the water passage conduit (not shown) as described previously, the water will be able to flow at a faster rate than the rate at which the water flows through the water passage conduit (not shown), passing through each of the first water passage holes 8. Then, the water will be guided along the same circumferential direction (the direction of the arrow 9) while it is being directed by the water guide member 15 toward the oblique and downward direction (the direction of the arrow 102).

In this embodiment, the plurality of second water passage holes 70 formed on the second plate member 4 can have any size of the total water passage cross-sectional area regardless of the position in which the plurality of second water passage holes 70 are located on the second plate, if the water can be discharged from those second water passage holes 70 toward the downward direction (in the direction of the arrow 106).

This is because the first plate member 3, the first water passage holes 8 and the water guide member 15 have the type and construction that allow the water flowing as indicated by the arrows 103*a*, 103*b* to flow more energetically and at the faster rate.

As the water can flow more energetically and at the faster rate as shown by the arrows 103*a*, 103*b*, the second plate member 4 and the plurality of second water passage holes 70 formed thereon can provide the effective means of controlling the rate and energy of the water flow until it can be reduced to the rate that is suited to the usage of any water supply equipment on which the water saving device 51 may be mounted.

In the example shown in FIG. 7 (*b*), the second plate member 4 having the flat, round shape may be of the type on which a plurality of second water passage holes having a small diameter can be formed. This type of water saving device is suitable when it is mounted on the automatic hand washing apparatus in the washboard.

As shown in FIG. 7 (*c*), the second plate member 4 having the flat, round shape may be of the type on which a plurality of second water passage holes can be formed at regular intervals with regard to each other along the circumferential direction so that they can extend in the circumferential direction. This type of water saving device may be used on the tap in the kitchen because the tap allows water to be discharged in the direction of the arrow 106 more energetically than the type shown in FIG. 7 (*b*).

When either type of the water saving device shown in FIG. 7 (*b*) and FIG. 7 (*c*) is used on the automatic hand washing apparatus in the kitchen, the water saving device can provide the amount of water that is suited for uses such as washing hands and fingers and cleaning dishes in the kitchen. As the amount of water per unit time that is delivered in the direction of the arrow 106 can be kept to the minimum, the user can feel the comfortable sense of the usage.

The case in which the water saving device 51 according to this embodiment in which the type of second plate member 4 shown in FIG. 7 (*b*) is mounted on the automatic hand washing apparatus in the kitchen and the case in which such water saving device 51 is not mounted are compared for the experimental purposes. In either of those cases, the water saving device has the water passage conduit or pipe of 13 mm in diameter (the total water passage cross-sectional area of 132.77 $mm^2$), the four first water passage holes having the total water passage cross-sectional area of 14.08 $mm^2$, and the 29 second water passage holes having the total water passage cross-sectional area of 11.15 $mm^2$).

When the case of the water saving device 51 in which it is mounted is compared against the case of the water saving device on which it is not mounted, it is found that the former can reduce the amount of water by between 70% and 80%. When this water saving device is used for washing hands or fingers on the automatic hand washing apparatus, it is also found that the user can have the comfortable sense of the usage.

In the above manner, the water saving device 51 according to this embodiment can be used whether the water may be supplied from the water supplying source under the high pressure or under the low pressure, or whether the larger amount or smaller amount of water may be supplied from the water supplying source. Thus, the amount and pressure of water that can satisfy the comfortable sense of usage can be provided. The amount of water per unit time that the user uses can be kept to the minimum, and the high energy effect can be provided.

The water saving device 51 that has been described above according to this embodiment has the construction in which the upper side of the hollow cylindrical body 2 (that is, the inner periphery of the upper side) that is to be attached to the water passage conduit (pipe) has the threaded portion. It is noted, however, that the water saving device may have the construction in which the upper side has no threaded portion, like the case of the water saving device 1 according to the embodiment 1 that has been described above using FIG. 1 and FIG. 2.

Although the present invention has been described concerning its preferred embodiment and examples thereof by referring to the accompanying drawings, it should be understood that the present invention is not limited to the preferred embodiment and examples thereof, which may be modified in various manners without departing from the spirit and scope of the present invention as defined in the appended claims.

Figure 1:
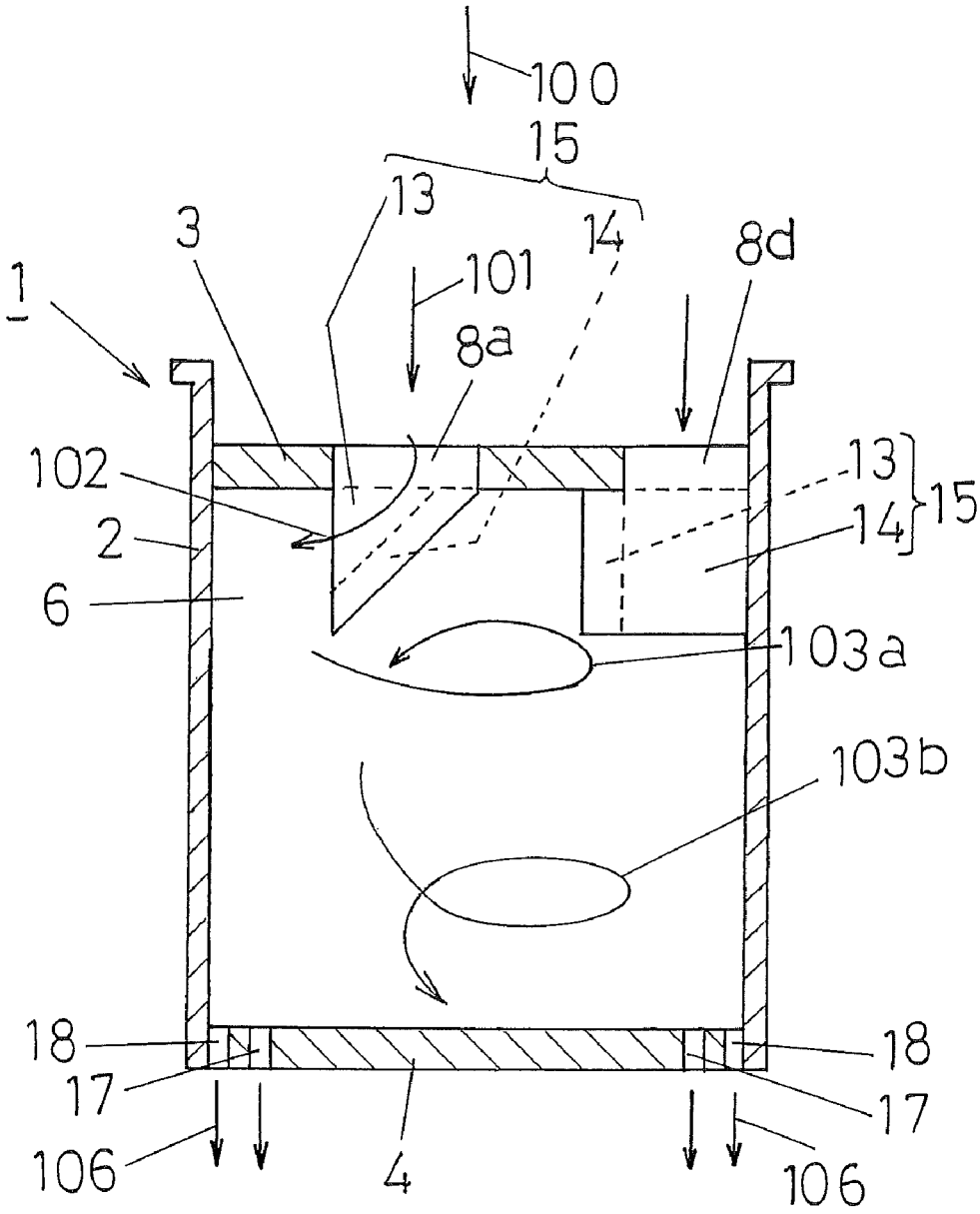
FIG. 1 is a longitudinal cross sectional view illustrating how the water flows through the water saving device according to one embodiment of the present invention, although some parts are not shown.
Figure 2:
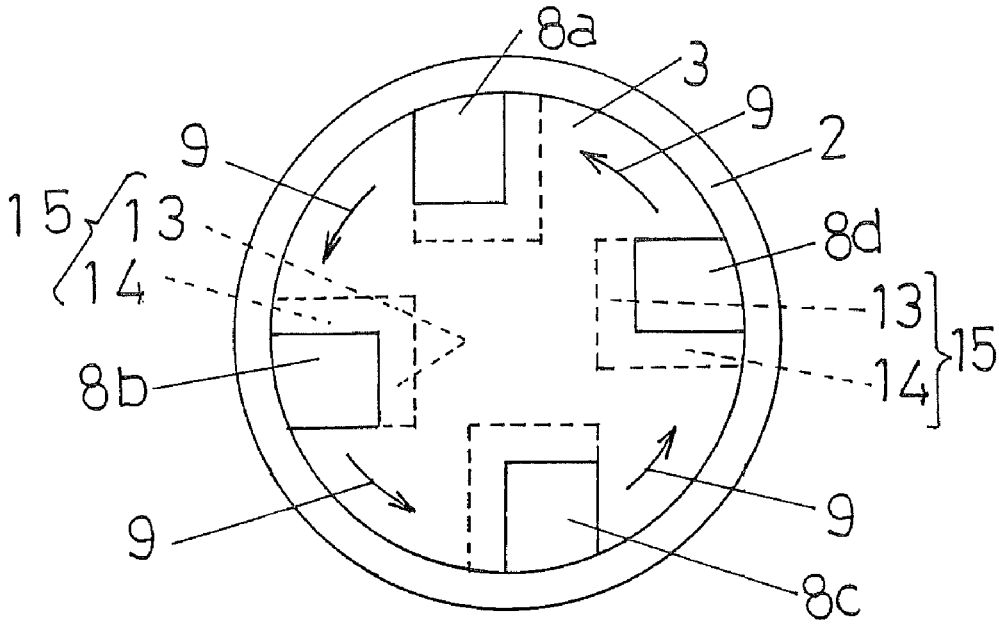
FIGS. 2 (*a*) and (*b*) are plan views illustrating a first plate member and a second plate member according to the embodiment shown in FIG. 1, respectively.
Figure 2:
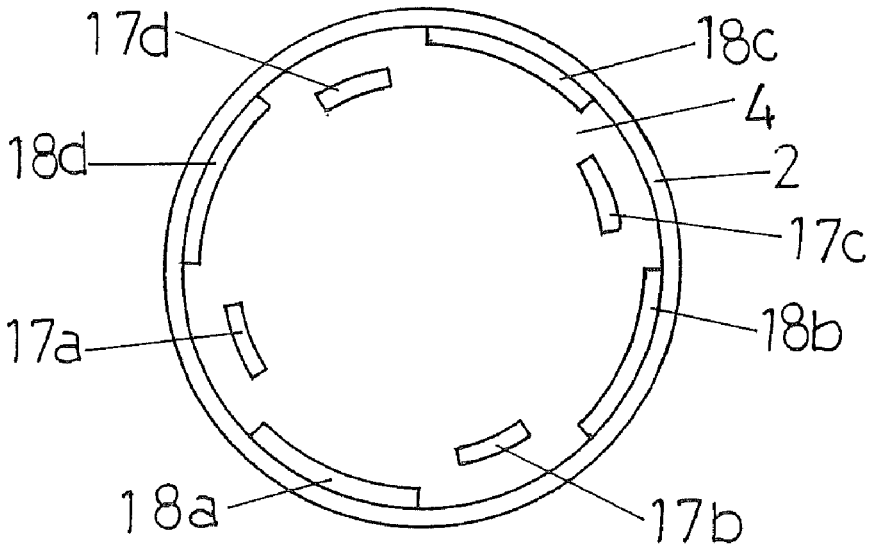
Figure 3:
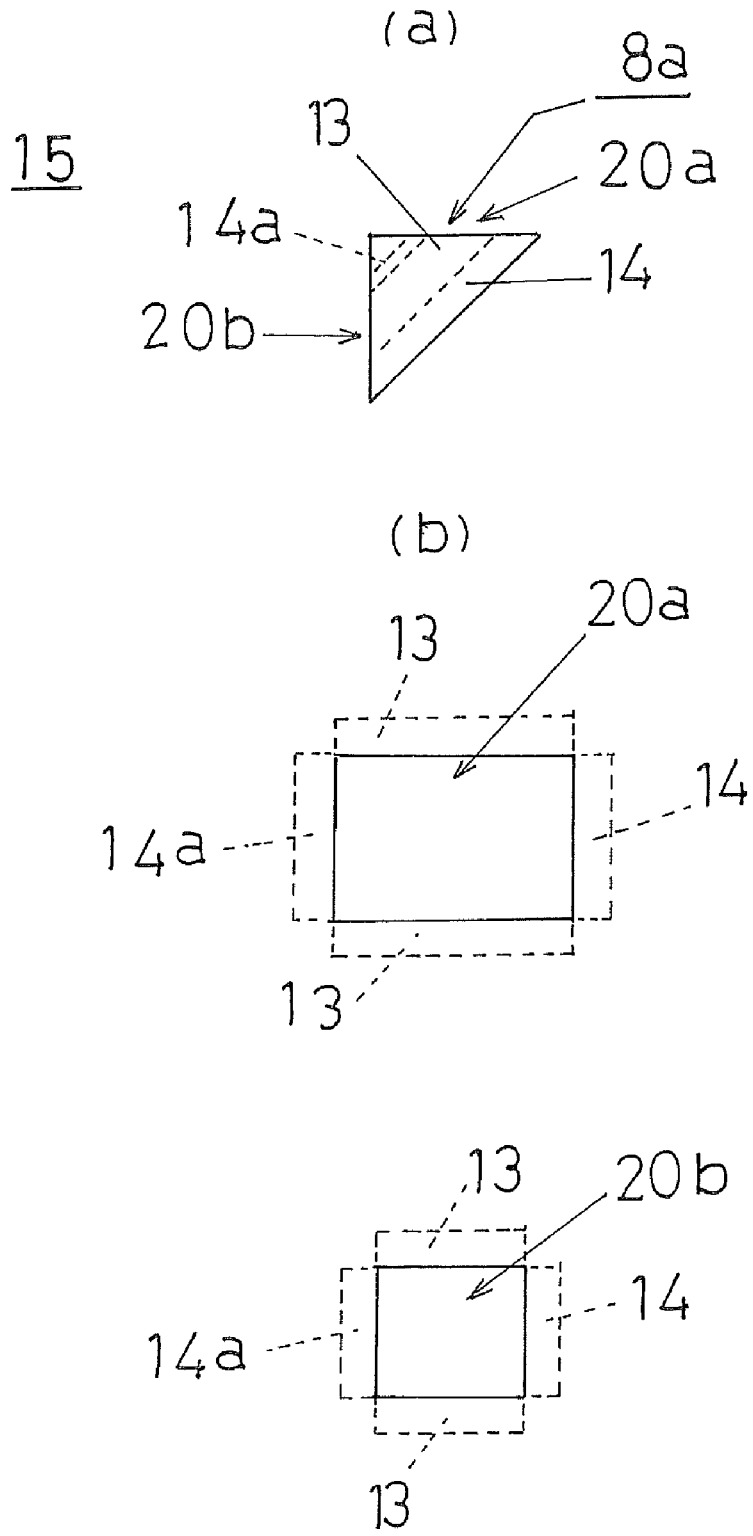
FIG. 3 is a diagram illustrating an example in which a guide member is formed as a guide passage in which (*a*) shows a side view and (*b*) explains the size of the cross section area in the inlet and exit of the guide passage.
Figure 4:
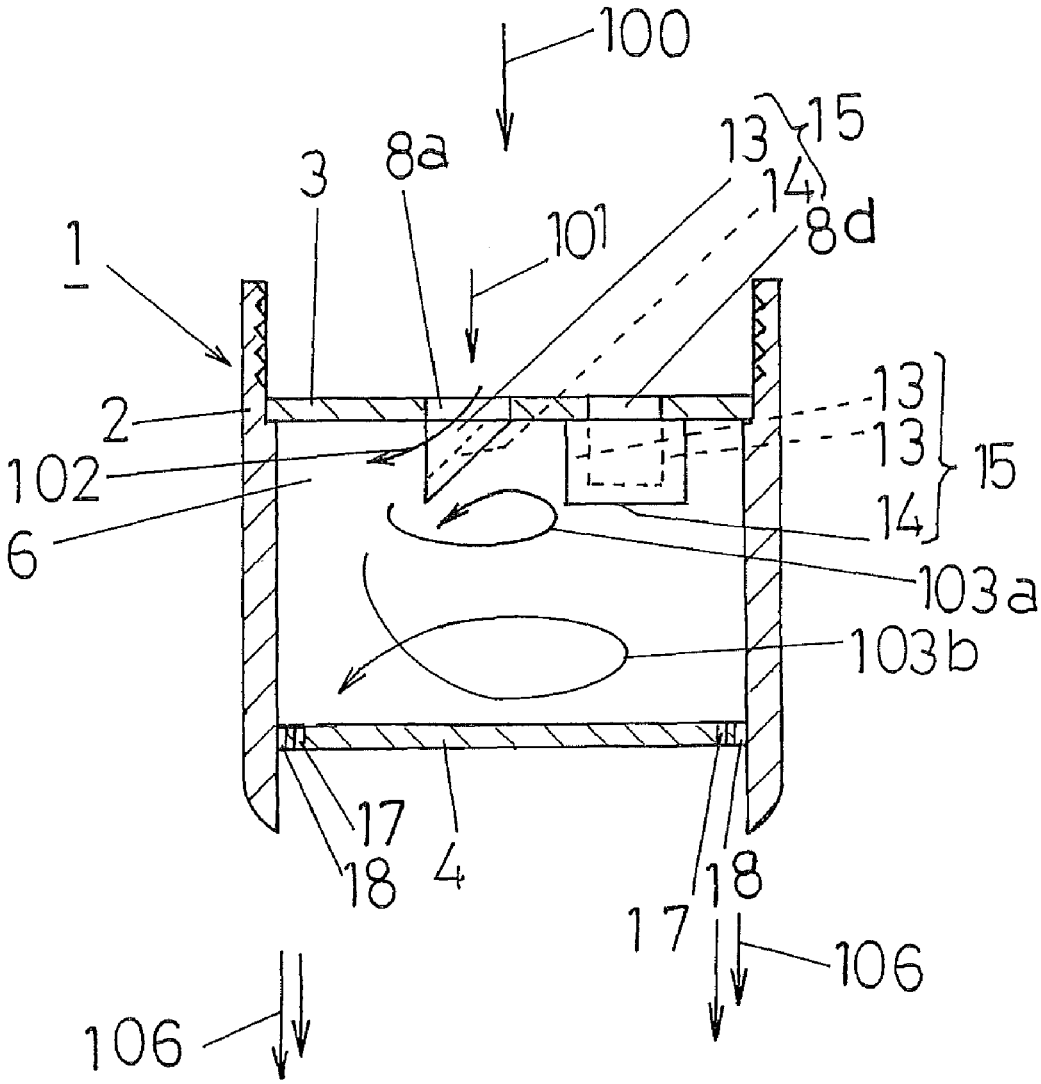
FIG. 4 is a longitudinal cross sectional view illustrating how the water through the water saving device according to another embodiment of the invention, although some parts are not shown.
Figure 5:
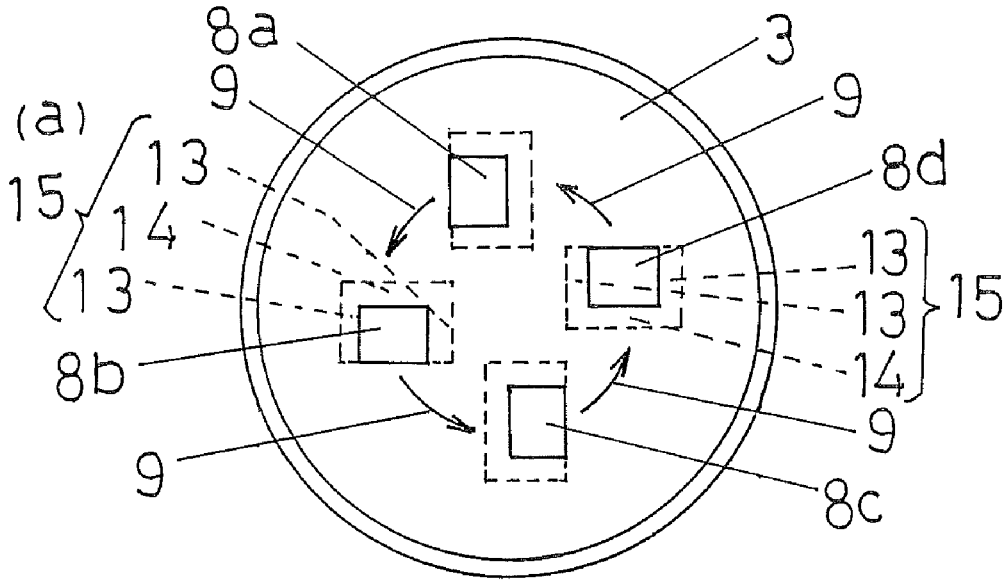
FIGS. 5 (*a*) and (*b*) are plan views illustrating a first plate member and a second plate member according to the embodiment shown in FIG. 4, respectively.
Figure 5:
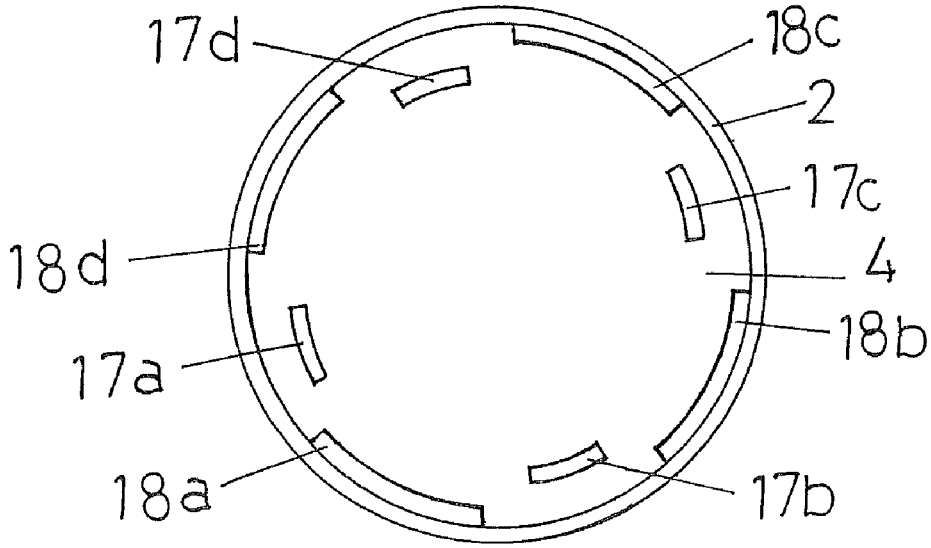
Figure 6:
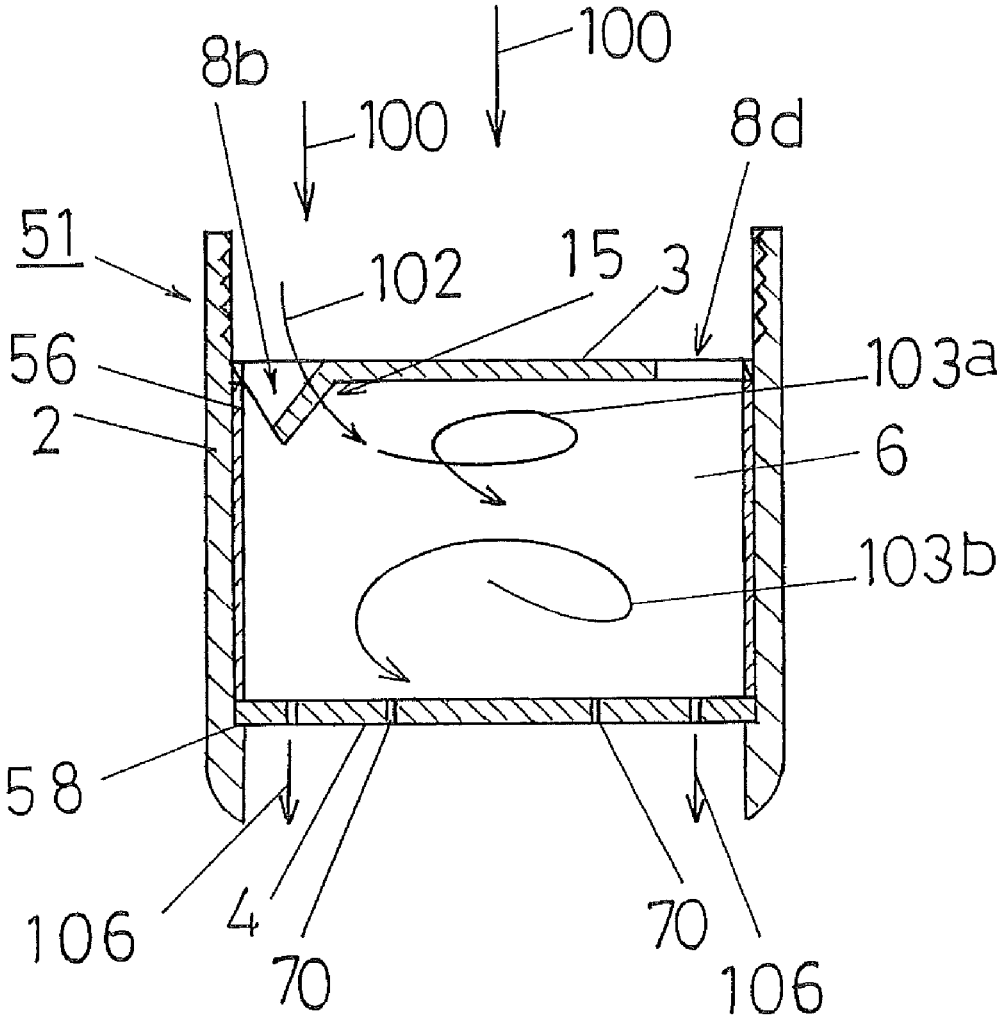
FIG. 6 is a longitudinal cross sectional view illustrating how the water through the water saving device according to still another embodiment of the invention, although some parts are not shown.
Figure 7:
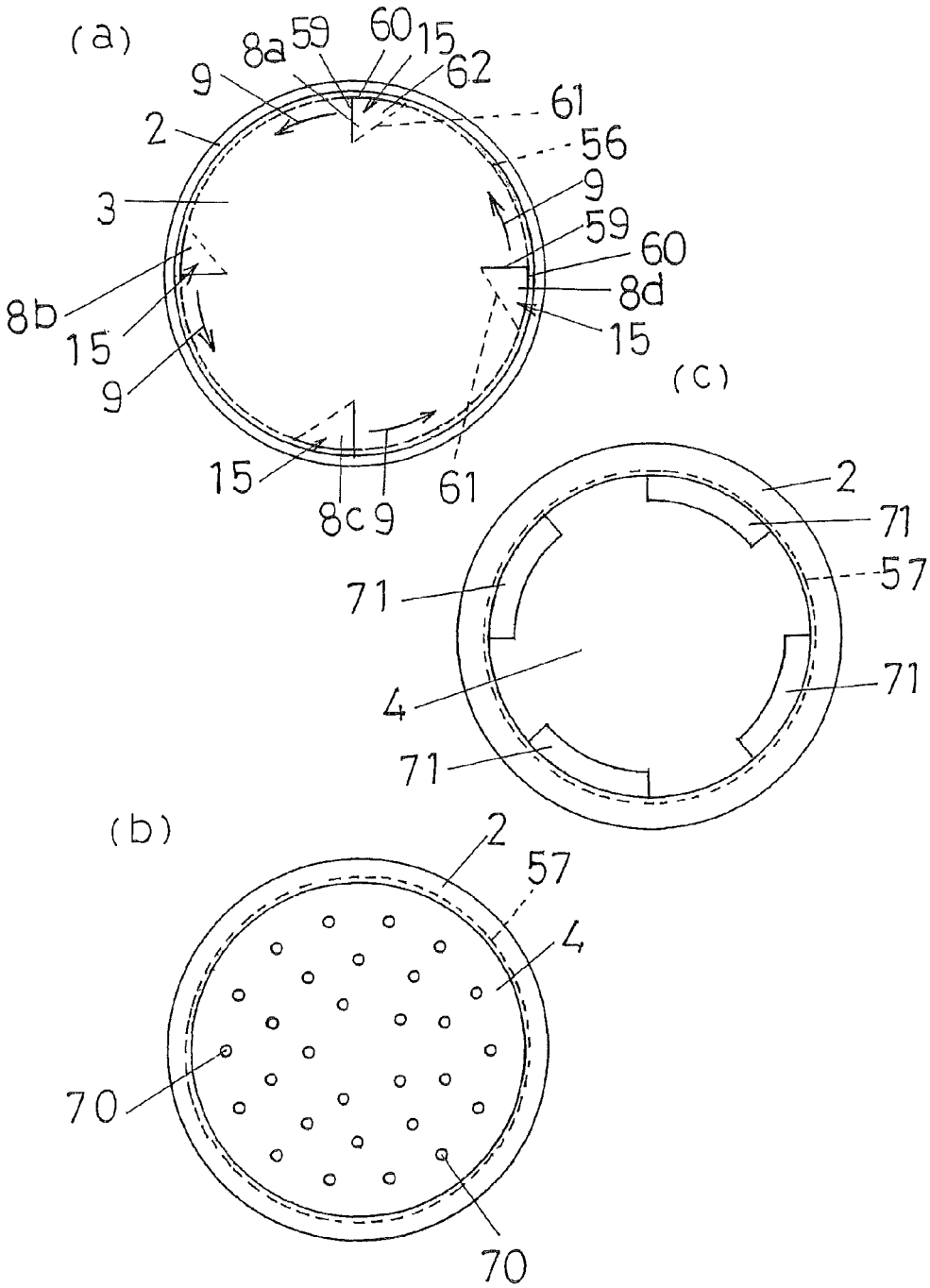
FIGS. 7 (*a*) and (*b*) are a plan view of a first plate member and a bottom view of a second plate member in the embodiment of FIG. 6, respectively, and (*c*) is a bottom view of the second plate member in another embodiment.
Figure 8:
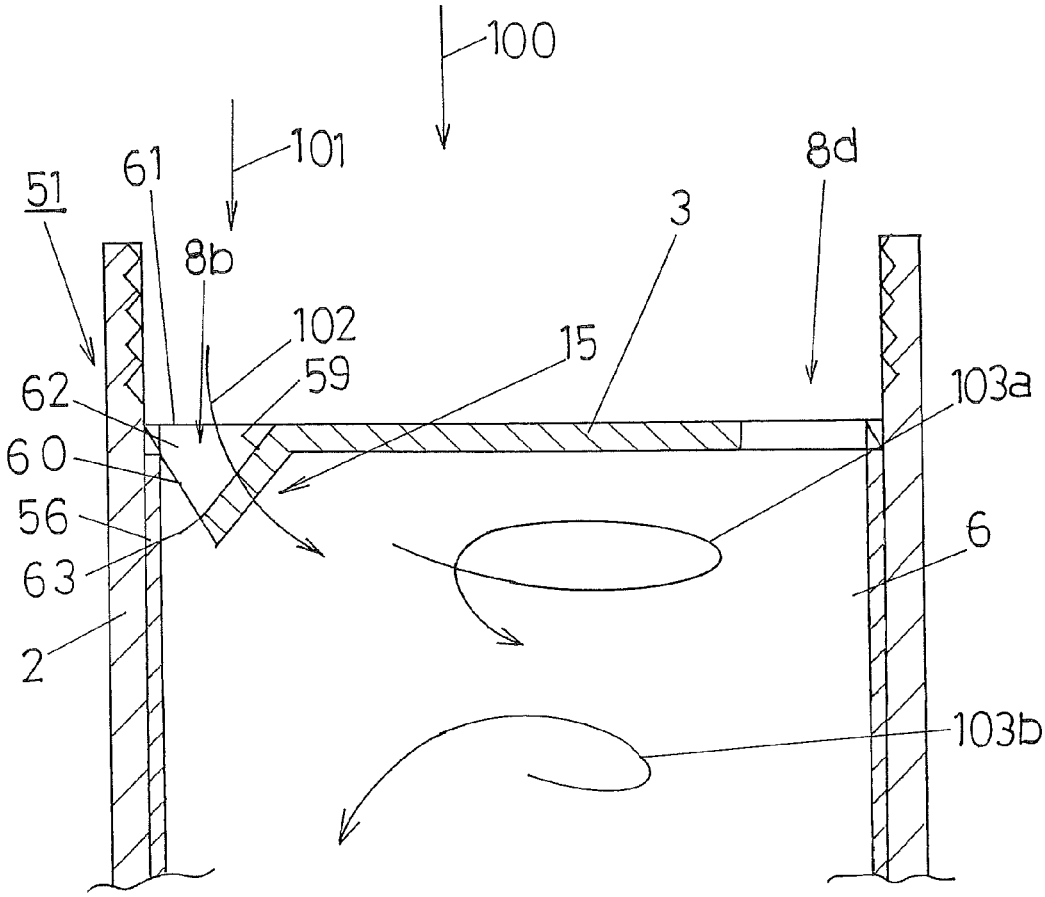
FIG. 8 is a partly enlarged view of FIG. 6.
Figure 9:
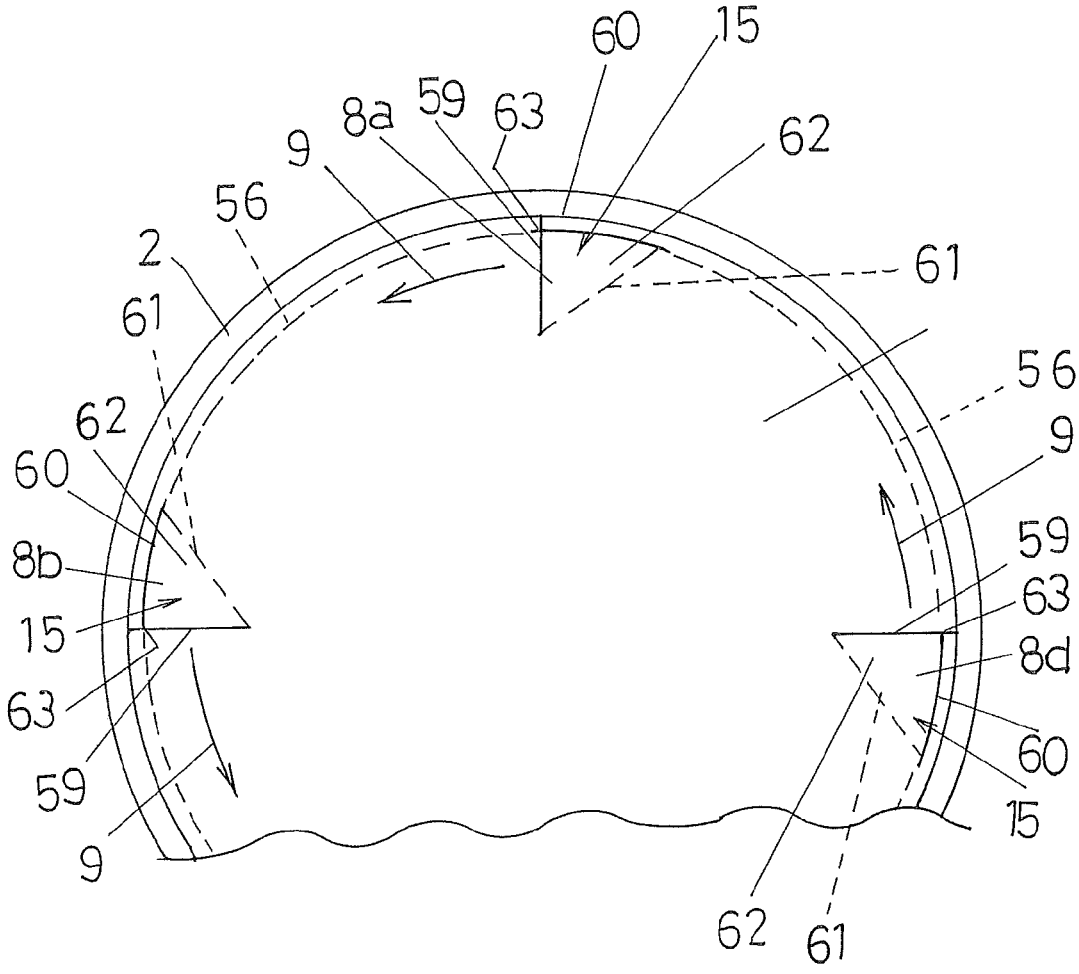
FIG. 9 is a partly enlarged view of FIG. 7 (*a*).

What is claimed is:

1. A water saving device comprising a hollow cylindrical body that is adapted to be attached to a water passage conduit, wherein the hollow cylindrical body includes a first plate member disposed perpendicular to the direction of the water flow passing through the water passage conduit toward the downstream side of the water flow from the side of the hollow cylindrical body on which it is attached to the water passage conduit, the first plate member having a plurality of first water passage holes formed at regular intervals with regard to each other in the circumferential direction and including a water guide member provided on the location where each of the first water passage holes is formed on the downstream side of the first plate member and being capable of guiding the water flow along the circumferential direction while the water flow toward the downstream side through each of the first water passage holes is being directed obliquely and downwardly, and wherein the hollow cylindrical body further includes a second plate member disposed in parallel with the first plate member on the downstream side of the position in which the first plate member is disposed, the second plate member having a plurality of water passage holes through which the water flow toward the downstream side through the first water passage holes is directed toward the downstream side, the plurality of second water passage holes provided on the second plate member having the total water flow cross-sectional area smaller than that of the plurality of first water passage holes.

2. A water saving device comprising a hollow cylindrical body that is adapted to be attached to a water passage conduit, wherein the hollow cylindrical body includes a first plate member disposed perpendicular to the direction of the water flow passing through the water passage conduit toward the downstream side of the water flow from the side of the hollow cylindrical body on which it is attached to the water passage conduit, the first plate member having a plurality of first water passage holes formed at regular intervals with regard to each other in the circumferential direction and including a water guide member provided on the location where each of the first water passage holes is formed on the downstream side of the first plate member and being capable of guiding the water flow along the circumferential direction while the water flow toward the downstream side through each of the first water passage holes is being directed obliquely and downwardly, and wherein the hollow cylindrical body further includes a second plate member disposed in parallel with the first plate member on the downstream side of the position in which the first plate member is disposed, the second plate member having a plurality of water passage holes through which the water flow toward the downstream side through the first water passage holes is directed toward the downstream side, and the plurality of second water passage holes provided on the second plate member being formed at regular intervals with regard to each other in the circumferential direction and extending along the circumferential direction in the radial outside region of the second plate member, wherein the plurality of second water passage holes provided on the second plate member has the total water flow cross-sectional area smaller than that of the plurality of first water passage holes.

3. The water saving device as claimed in claim 1, wherein the water guide member includes a triangular-shaped portion for forming each of the first water passage hole and being bent downwardly toward the downstream side in the position in which each of the first water passage holes is formed on the first plate member, and is provided so that it can guide the water flow along the circumferential direction while the water flow is being directed obliquely downwardly between the surface on the inner peripheral wall of the hollow cylindrical body and the surface of the triangular-shaped portion being thus bent downwardly toward the downstream side.

4. The water saving device as defined in claim 1, wherein after the second plate member having a flat round shape is inserted into the hollow cylindrical body from its tip and is then mounted on the stepped portion of the hollow cylindrical body, a cylindrical spacer and the first plate member having a flat round shape are to be inserted into the hollow cylindrical body from its top in the order listed above.

5. The water saving device as claimed in claim 2, wherein the water guide member includes a triangular-shaped portion for forming each of the first water passage hole and being bent downwardly toward the downstream side in the position in which each of the first water passage holes is formed on the first plate member, and is provided so that it can guide the water flow along the circumferential direction while the water flow is being directed obliquely downwardly between the surface on the inner peripheral wall of the hollow cylindrical body and the surface of the triangular-shaped portion being thus bent downwardly toward the downstream side.

6. The water saving device as defined in claim 2, wherein after the second plate member having a flat round shape is inserted into the hollow cylindrical body from its tip and is then mounted on the stepped portion of the hollow cylindrical body, a cylindrical spacer and the first plate member having a flat round shape are to be inserted into the hollow cylindrical body from its top in the order listed above.

7. The water saving device as defined in claim 3, wherein after the second plate member having a flat round shape is inserted into the hollow cylindrical body from its tip and is then mounted on the stepped portion of the hollow cylindrical body, a cylindrical spacer and the first plate member having a flat round shape are to be inserted into the hollow cylindrical body from its top in the order listed above.

* * * * *